United States Patent [19]

Trautlein

[11] 4,407,524

[45] Oct. 4, 1983

[54] DURABLE DATA-TAG WITH RECORD DUPLICATION

[75] Inventor: Ray W. Trautlein, Dublin, Pa.

[73] Assignee: Lem Products, Inc., Doylestown, Pa.

[21] Appl. No.: 186,161

[22] Filed: Sep. 11, 1980

[51] Int. Cl.[3] ..... B41L 1/14; G09D 3/00

[52] U.S. Cl. ..... 282/9 R; 229/74; 283/79

[58] Field of Search ..... 282/9 R, 22 A, 25, 8 A; 283/18, 20, 21, 62, 79, 80, 81; 229/74, 80

[56] References Cited

U.S. PATENT DOCUMENTS

| | | | |
|---|---|---|---|
| 558,712 | 4/1896 | Blackhall | 282/9 R |
| 712,681 | 11/1902 | Huffman | 282/22 A |
| 1,391,872 | 9/1921 | White | 282/9 R |
| 1,774,090 | 8/1930 | Gladfelter | 283/20 X |
| 2,677,556 | 5/1954 | Hill | 283/62 X |
| 3,272,532 | 9/1966 | Owen | 283/20 |
| 3,987,960 | 10/1976 | Gardiner | 283/79 X |
| 4,159,586 | 7/1979 | Blum | 283/18 X |

*Primary Examiner*—Paul A. Bell
*Assistant Examiner*—John S. Brown
*Attorney, Agent, or Firm*—Ferrill and Logan

[57] ABSTRACT

A durable weather and corrosive environment resistant and tamper-proof data record tag having a durable backing member and an adhesive clear cover member, this cover member including a releasable separator sheet adhered thereto; a plurality of identical record form sheets, stacked or layered one upon another and upon the backing member for providing a duplicate identical record of information simultaneously written on to each of the record sheets and on the backing member, whereof the layered sheets are attached at one end to the backing member, these layered sheets and the backing member each containing a weakened portion adjacent the attachment.

12 Claims, 4 Drawing Figures

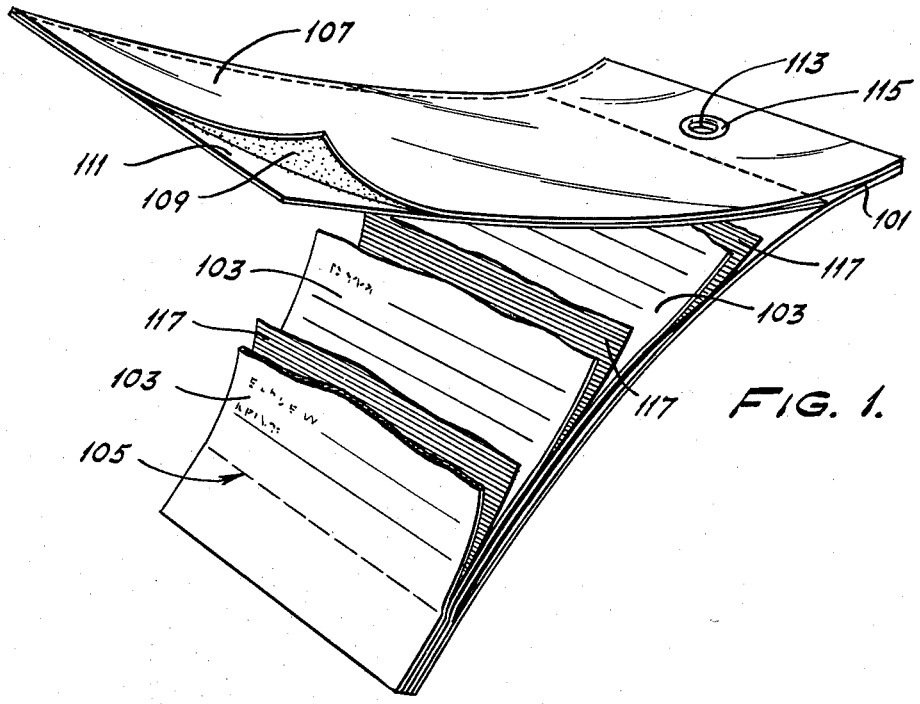
FIG. 1.
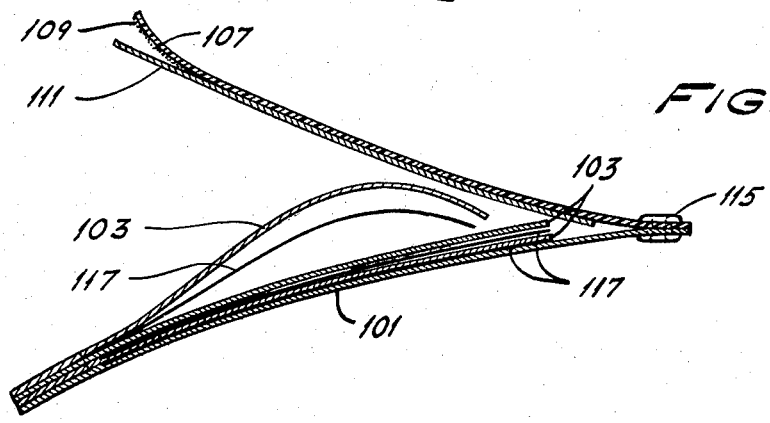
FIG. 2.
FIG. 3.
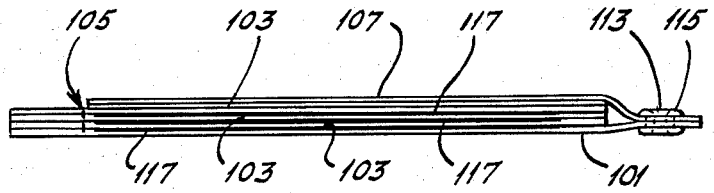
FIG. 4.
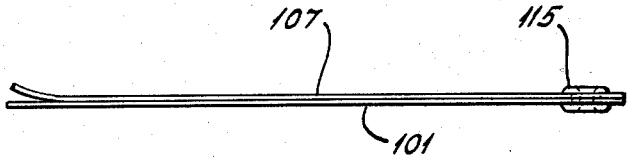

DURABLE DATA-TAG WITH RECORD DUPLICATION

BACKGROUND OF THE INVENTION

This invention relates to multi-layered labels or tags and especially to write-on tags having protective clear plastic covers with pressure-sensitive adhesive surfaces.

The use of multi-layered duplicate record forms had been practiced for many, many years; especially since the advent of carbon paper and pressure-sensitive contact impression paper as an alternative to the use of carbons. This simultaneous generation of duplicate records has found itself into mailing labels and tags including those used by the United States Postal Service. A typical duplicate record mailing label is used for express mail and next day service and includes a plurality of duplicate record sheets layered one upon the other. The sheets are then separable to provide individual forms for various departments. These labels, however, are not weather or corrosive environment resistant nor are they tamper-proof.

LEM Products, Inc. of Doylestown, Pa., has marketed durable weather and corrosive environment resistant tags having an opaque plastic backing member with a direct data record surface thereon and a clear plastic cover member being adhered to the data surface of the backing sheet via an inter-facing adhesive layer.

Julian Blum, U.S. Pat. No. 4,159,586, describes a multi-layered labeling system comprising an adhesive backed writing tag and an adhesive surfaced transparent cover adhered to the writing surface, both the cover and writing surface are adhered to an independent support surface to provide a secured mounting and environment resistant label.

As the multi-layered duplicate copy paper systems which have been traditionally used do not provide a durable weather and corrosive environment resistant tag nor copies which are tamper or alteration resistant, and the LEM Products, Inc. tag and the Blum labeling system do not provide duplicate copies, simultaneously generated, and a tamper-proof tag, it is desirable to provide a data-tag encompassing all of these features.

An object of the present invention is to provide a data-tag with duplicate records having multi-layered duplicate data record sheets for simultaneously generating duplicate records.

A second object of this invention is to provide such data-tag with a quick release or separation of the identical duplicate records from the primary record once the data has been entered.

A further object of this invention is to provide the record, indirectly deposited on durable weather and corrosive resistant material, which record is easily readable.

An even further object of this invention is to provide a clear durable cover which can mate with the record sheet to provide a weather and corrosive resistant encapsulation of the record, this cover sheet having its inter-facing surface coated with a substance which contributes to the weather and corrosive seal and which will provide a distortion of the data record if the seal is broken once made.

An even further object of this invention is to provide the data information with record medium on the protective backing member which record medium separates or otherwise distorts from the backing member when the cover member is lifted.

SUMMARY OF THE INVENTION

The objects of the present invention are realized in a durable data-tag having layered record copy sheets for generating a plurality of duplicate records simultaneously. Such duplicate plural record sheets are separable from the tag leaving the permanent record with its duplicately generated data recorded thereon.

An opaque plastic backing sheet may have a record form printed thereon. An identical record form appears on a plurality of separable data sheets where these separable sheets are stacked upon one another and attached to the backing sheet. An impression depositing duplication medium may be interdispersed between the layers of duplicate record sheets as well as the bottom duplicate record sheet and the plastic backing sheet to enable the simultaneous generation of a data record. The duplicate record sheets may be attached to the plastic backing sheet at one side thereof allowing for a lifting away and inspection while in attached placement. A weakened portion or perforation through the plural record sheets and backing sheet facilitates the stripping away of the attachment section freeing the duplicate record sheets.

A clear plastic cover sheet may be attached to the printed data bearing side of the plastic backing sheet at a point away from or deseparate the duplicate data sheet attachment. This cover sheet may have a pressure-sensitive adhesive coating or other sealant material layer on its backing sheet, inter-facing side. A strippable separator sheet may cover this adhesive or sealant layer. The clear cover sheet may extend to the limits of the data portion of the plastic backing sheet and is foldable upon the duplicate data record providing protection during storage and before use.

DETAILED DESCRIPTION OF THE DRAWINGS

The advantages, features and operation of this invention will be readily understood from a reading of the following detailed description of the invention in conjunction with the attached drawings in which like numerals refer to like elements and in which:

FIG. 1 is a perspective view of the data-tag, partially open and showing its duplicate data record sheet in place.

FIG. 2 is a side sectional view of the opened data-tag of FIG. 1.

FIG. 3 is a side elevation of the data-tag before use, showing the clear top sheet folded over and protecting the plural duplicate data sheets.

FIG. 4 is a side elevation of the data-tag with the duplicate plural data sheets removed along with the detachable backer member portion and showing the clear cover sheet adhered to the permanent record backing sheet.

DETAILED DESCRIPTION OF THE INVENTION

A durable data-tag with record duplication in its principal embodiment has, FIG. 1, an opaque durable and flexible plastic backing sheet 101 of any of a plurality of pre-selected colors. This backing sheet 101 can be made from vinyl material or polyethylene or polypropylene or any other plastic which in the composition or formula used provides an easily flexible and tough as well as weather and corrosive resistant material having a smooth surface for receiving the depositing of writing thereon. One surface of this backing sheet 101, being the top or inner-facing surface, contains a form area dedicated for receiving the data or information. The backing sheet 101 may be cut to any size or shape but is most conveniently of rectangular shape.

A plurality of duplicate data record sheets 103 are stacked one upon the other with their data side facing the same direction as the data surface of the backing sheet 101. These plural duplicate data sheets 103 which each contain a form identical to the form on the backing sheet 101 are made of paper and are attached together and to the backing sheet 101 at one end of the backing sheet. That attachment end of the backing sheet includes a weakened portion spaced inwardly from its end such as perforation 105. The duplicate data sheets 103 are also perforated 105 at the same location allowing for a simultaneous detachment of the attached areas of the data sheet 103 and the backing sheet 101 freeing the duplicate data sheets 103 information portions from one another and from the backing sheet 101 information portions.

A visually clear plastic flexible cover sheet 107 is attached to the backing sheet 101 at the end opposite the perforation 105 and duplicate data sheets 103 attachment. This cover sheet 107 contains a layer of adhesive material 109 on its inside or interfacing surface. Positioned against the inside adhesive surface of the cover sheet 107 and covering the adhesive layer 109 is a removable separator sheet 111 of strippable paper. The cover sheet 107 can be made of the same or compatible plastic sheeting as the backing sheet 101, and be easily flexible, tough and durable.

A hole 113 extends through the cover sheet 107 and backing sheet 103 through their permanent attachment portion opposite the perforation 105 end of the backing sheet 101 which is used for attaching the data-tag to a piece of equipment or other object. A grommet 115 or similar reinforcing member is positioned about the hole 113 to provide a strengthened structural feature. As an alternative, the backing sheet 101 could be adhesive backed enabling it to be adhesively attached to a piece of equipment.

A plurality of carbon papers 117 are inter-leafed between each of the plural duplicate data sheets 103, the last one of these carbon papers 117 being adjacent to the data portion of the backing sheet 101. These carbon papers 117 are positioned to leave a duplicate record on the adjacent form portion underneath so that the top duplicate data sheet 103 provides the original writing surface and each duplicate data sheet 103 form portion underneath receives a carbon impression as a result of the original writing, the backing sheet 101 form area also receives a carbon impression. The data or information which remains with the data-tag once the duplicate data sheets 103 are removed has been indirectly deposited by operation of the original writing on the top data sheet 103 and the pressure against the carbon paper 117 adjacent the form portion of the plastic backing sheet 101.

The plastic backing sheet 101 and clear cover sheet 107 may be made of similar or dissimilar plastics. Such plastics can be clean of manufacturing residue such as mold and release material or other oily substances in order to take a written impression. They can have a smooth shiny appearance consistent with most vinyl or a dull surface. It is preferable that the data form portion of the backing sheet 101 have a dull finish which will facilitate reading of the imprinted data and adherence of ink or other substance deposited thereon.

The duplicate data sheets 103 may be made of ordinary paper having any of a plurality of weights, each data sheet 103 being color-coded or otherwise marked to designate its ultimate use or purpose.

The layer of adhesive material 109 is preferably of a pressure-sensitive type commonly available in the marketplace and of a strength which will securely hold the cover sheet 107 to the backing sheet 101 without an easy release and which will seal the backing sheet 101 data surface (form area) against moisture and corrosive material.

The carbon papers 117 are of a type commonly available in the marketplace which provide a sufficiently heavy depository of carbon impregnated ink on the underlyiing surface when when average writing pressure is used.

The release paper 111 may be selected from any of those commonly available in the marketplace and which has one release surface coated with a plastic or wax material allowing for an easy release from the adhesive material layer 109 without leaving a residue thereon and still leaving the adhesive intact.

It is desirable that the cover sheet 107, data area of the backing sheet 101, duplicate data record sheets, adhesive layer 109 and separator sheet 111 be of the same shape and area. This will enable the cover sheet 107 with its attached separator sheet 111 to lay over the duplicate data sheets 103 and data or form portion of the backing sheet 101 during storage of the data tag thereby protecting these elements. It will also enable the cover sheet 107 to completely seal the data form side of the backing sheet 101 once the duplicate data sheets 103 are detached and the separator sheet 111 removed.

The data-tag in side elevation cross-section, FIG. 2, shows the plurality of duplicate data sheets 103 stacked identically upon one another with the carbon papers 117 interdispersed therebetween and between the backing sheet 101. This provides a slightly bulkier profile than the attachment area adjacent to the perforation 105 where these data sheets 103 are glued together, or otherwise attached, along with the carbon papers 117 and the backing sheet 103. Many other attachment means than gluing or stapling such as heat fusing may be substituted, depending upon the materials selected for the backing sheet 101, data sheets 103 and carbon papers 117.

In its fully loaded and folded form, FIG. 3, the cover sheet 107 and release paper 111 fold down and over the duplicate data sheets 103 protecting them from dirt and soiling and providing a relatively thick layer of material which inhibits the carbon depositing action of the carbon papers 117 if slight to moderate pressures are encountered on the outer sides of the data-tag.

With the perforation 105 attachment section detached from the backing sheet 103, FIG. 4, and the release paper 111 removed from the adhesive material layer 109 on the cover sheet 107, the cover sheet 107 may be laid down on top of the backing sheet 101 and adhesively sealed thereto sealing the data form area of the sheet 101 and any information written or entered thereon. A weather and corrosive environment resistant tag with a clear see-through cover has thereby been created having the data record thus encased. The duplicate data sheets 103 can be used by various record keeping departments with the assurance that an accurate duplicate data record has been generated.

The use of carbon paper 117 or impression paper which provides a contact printing and depositing of ink-loaded carbon particles on the data portion of the backing sheet, provides the means for assuring a tamper-proof data-tag. Economically practical and commercially available adhesives for the layer 109, being sufficiently strong to bond the backing and cover sheets, 101, 107, respectively, against environmental intrusion, while allowing release of the separator sheet 111 do not prohibit the separation of these two sheets 101, 107 by severe mechanical force. However, the carbon impression will partially adhere to the adhesive material 109 and be lifted off of the data sheet if the clear cover sheet 107 is ever pulled from the backing sheet 101 in an effort to change, add to or otherwise tamper with the data record sealed therewithin. While the carbon impression deposited upon the data portion of the backing sheet 101 may be erased, washed away or otherwise removed without leaving residual evidence of such tampering, the carbon impression picked up by the adhesive layer 109 on the cover sheet will not easily release such carbon particles. In fact, attempts to remove these carbon particles will distort, discolor or otherwise change the appearance of this adhesive layer 109 thereby changing the refractory properties of the cover sheet 107 when it has been readhered to the backing sheet 101. Evidence of change and/or tampering is thereby detected.

The data-tag at hand facilitates a method of providing a durable information record and accurate duplicate copies thereof, the durable information record being weather and corrosive resistant and showing evidence of tampering once the record is made. This method includes simultaneously generating duplicate records from a single writing or printing by utilizing overlaid and stacked data sheets interdispersed with contact impression-leaving or printing material, the bottom sheet being the permanent durable record upon which the ink/data is deposited. The method further includes encasing the permanent record by adhering a tough durable weather and corrosive resistant sheet upon said ink/data deposited surface, the sheet covering the data surface being clear and having on its total inter-facing surface adherent, this adhering being performed after the removing of the duplicate data sheets from the permanent durable record. Further, a tampering of the data on the data sheet is detected by inspecting the adhesive surface of clear plastic coverssheet for a distortion of the ink/data deposited on the bottom sheet and a distortion of the ink/data pick-up by the adhesive surface of the cover sheet.

Many modifications can be made in the design of the data-tag described above without deviating from the scope and intent thereof. It is intended therefore that the above description be taken as illustrative and not interpreted in the limiting sense.

What is claimed is:

1. A tag with record duplication comprising:

means for receiving data on one surface thereof, said data receiving means forming the backer sheet of said tag;

means for receiving an identical copy of data received by said data receiving means, said identical copy receiving means including sheets detachably secured to said data receiving means at a first end thereof;

means for providing a duplicate data imprint on said identical copy receiving means sheets and said data receiving means backer sheet, said duplicate data imprint means including imprint sheets interleafed with said identical copy receiving means sheets and being detachably secured to said data receiving means backer sheet at said first end thereof; wherein the detachment of said identical copy receiving means sheets and said duplicate imprint means sheets completely separates all of them away from said data receiving means backer sheet; and means for sealing said data imprint on said data receiving means backer sheet, said sealing means being attached to said data receiving means at the end opposite said first end.

2. The tag of claim 1 wherein said data receiving means comprises a plastic backing sheet having a data portion on the side adjacent said imprint sheets.

3. The tag of claim 2 wherein said sealing means includes a plastic cover sheet attached to said plastic backing sheet at said opposite end, said cover sheet including an adhesive coating on one surface thereof, said plastic cover sheet being capable of covering said duplicate data imprint means and said data receiving means.

4. The tag of claim 3 wherein said plastic backing sheet is an opaque sheet of tough plastic material and said cover sheet is a clear sheet of tough plastic material attached to said opposite end of said opaque plastic sheet, said adhesive coating being on the side of said clear plastic sheet adjacent said opaque plastic sheet.

5. The tag of claim 4 wherein said data receiving means includes a plurality of identical record sheets stacked one upon another and detachably attached to said opaque plastic sheet at said first end, and having a detachment portion thereof at said first end, said detachment portion allowing for the separation from said opaque backing sheet of all portions of said identical record sheets.

6. The tag of claim 5 wherein said duplicate data imprint sheets include a plurality of carbon papers interleafed between said plurality of record sheets, the bottom one of said carbon papers facing said opaque plastic sheet and detachably attached to said opaque backing sheet at said first end, and having a detachment portion allowing for the separation from said opaque backing sheet of all portions of said plurality of carbon papers.

7. A data tag system comprising:

an opaque plastic tag;

at least one sheet of paper removably attached to one end of said tag to overlay said tag and to receive a writing thereon;

carbon paper copy means for causing the information written on one said sheet of paper to be duplicated on said plastic tag and any additional sheets of paper removably attached to said tag;

all said paper and said carbon copy means being completely removable from said tag by tearing away;

a transparent plastic protective cover sheet affixed directly upon the upper surface of said tag at the opposite end thereto, said cover sheet having a pressure sensitive adhesive coating on its under side; and a strippable separator sheet applied upon said adhesive side of said cover sheet, said cover sheet with its strippable separator sheet serving as a protective shield of said paper and said carbon paper copy means prior to entry of the writing, and thereafter, following removal of all said paper and said carbon paper copy means, followed by removal of said strippable separator sheet, said cover sheet serving as the protective lamination directly adhered to the top of the tag to protect the information recorded thereon;

wherein said at least one paper sheet, said at least one carbon sheet and said tag are bound together at said one end to form a stub, a perforation line providing a separation between said bound stub area and the remaining portions of said tag and said paper and said carbon sheet, said perforation line permitting said complete removal of said stub end and said paper sheet and said carbon sheet from said tag.

8. A data tag with duplicate recording means having a separation feature making possible a durable remaining tag structure free of paper waste stubs, comprising:

a plurality of record papers;

a plurality of carbon papers interleafed between said record papers;

a durable backer sheet;

a durable cover sheet;

wherein said plural record papers and plural carbon papers are interleafed and bound together at one end and attached to a first end of said backer sheet said one end to form a stub capable of complete separation from said backer sheet;

wherein said plural record papers, said plural carbon papers and said backer sheet each contain a perforation line proximate said attachment first end; and wherein said durable cover sheet is attached to said backer sheet at the end opposite said first end and capable of overlaying said interleafed plural record papers and said plural carbon papers.

9. The tag of claim 1 wherein said durable backer sheet is capable of accepting a carbon imprint record; wherein said perforation line separates the record portion of said plural record papers and said backer sheet from the bound attachment thereof forming stub ends; and wherein said perforationline facilitates the complete separation, by tearing off said stub ends, freeing, completely, said stub ends, said plural record papers and said plural carbon papers from each other and said backer sheet imprint record portion with attached cover sheet.

10. The tag of claim 9 also including an adhesive coating on said cover sheet side facing said backer sheet; a separator sheet covering said adhesive coating wherein said separator sheet removal leaves said adhesive coating intact.

11. The tag of claim 10 wherein said adhesive coating is capable of sealing said cover sheet to said backer sheet record portion side.

12. The tag of claim 11 wherein said cover sheet is of clear flexible plastic; wherein said backer sheet is of opaque flexible plastic; and wherein said adhesive coating provides a seal which is weather and corrosive environment resistant between said cover and backer sheets.

* * * * *

UNITED STATES PATENT AND TRADEMARK OFFICE

CERTIFICATE OF CORRECTION

PATENT NO. : 4,407,524

DATED : October 4, 1983

INVENTOR(S) : Ray W. Trautlein

It is certified that error appears in the above-identified patent and that said Letters Patent is hereby corrected as shown below:

Column 8, line 5 should read:

"9. The tag of claim 8 -- "

Signed and Sealed this

*Eleventh* Day of *December 1984*

[SEAL]

*Attest:*

GERALD J. MOSSINGHOFF

*Attesting Officer* *Commissioner of Patents and Trademarks*